US006557177B2

(12) United States Patent
Hochmuth

(10) Patent No.: US 6,557,177 B2
(45) Date of Patent: May 6, 2003

(54) GLOVE WITH A REINFORCEMENT STRIP

(76) Inventor: Peter Hochmuth, Weissenburger Strasse 19, D-91757 Treuchtlingen (DE)

( * ) Notice: Subject to any disclaimer, the term of this patent is extended or adjusted under 35 U.S.C. 154(b) by 0 days.

(21) Appl. No.: 09/972,313

(22) Filed: Oct. 5, 2001

(65) Prior Publication Data

US 2002/0073477 A1 Jun. 20, 2002

(30) Foreign Application Priority Data

Oct. 5, 2000 (DE) ..... 200 17 233 U

(51) Int. Cl.[7] ..... A41D 19/00
(52) U.S. Cl. ..... 2/159; 2/161.1
(58) Field of Search ..... 2/16, 20, 159, 2/160, 161.1, 161.6, 163, 164, 169; 602/16, 21, 22; 128/878, 879; 473/205; 482/44, 47, 48

(56) References Cited

U.S. PATENT DOCUMENTS 4,144,881 A * 3/1979 Chappell ..... 602/16
4,727,862 A * 3/1988 Waddell et al. ..... 602/16
5,453,064 A * 9/1995 Williams, Jr. ..... 2/161.1

FOREIGN PATENT DOCUMENTS

DE 3516545 * 11/1986 ..... A63B/71/14

OTHER PUBLICATIONS

West Search, Abstract of DE 3516545.*

* cited by examiner

*Primary Examiner*—Gary L Welch
(74) *Attorney, Agent, or Firm*—Sidley Austin Brown & Wood, LLP

(57) ABSTRACT

A reinforcement strip (11) for embedding in forefinger and/or thumb area of a glove and having each a plurality of reinforcement members (12) arranged in a row, and a respective plurality of pivot joints for connecting each two adjacent reinforcement members, wherein the two adjacent reinforcement members have respective stop surfaces facing each other and abutting one another in an extended position of the two adjacent members, and wherein each pivot joint (13) includes a bearing cavity (15) and a pivot (16) engaging in the bearing cavity.

9 Claims, 4 Drawing Sheets

FIG.11
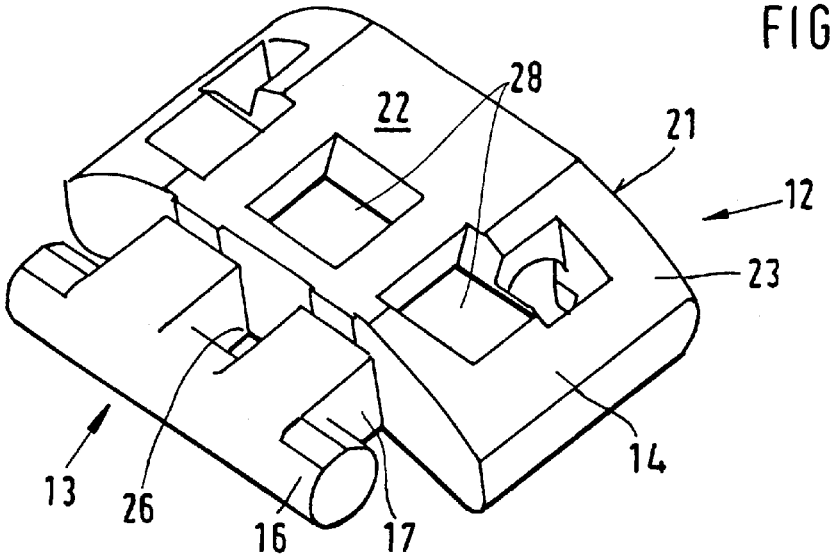
FIG.12
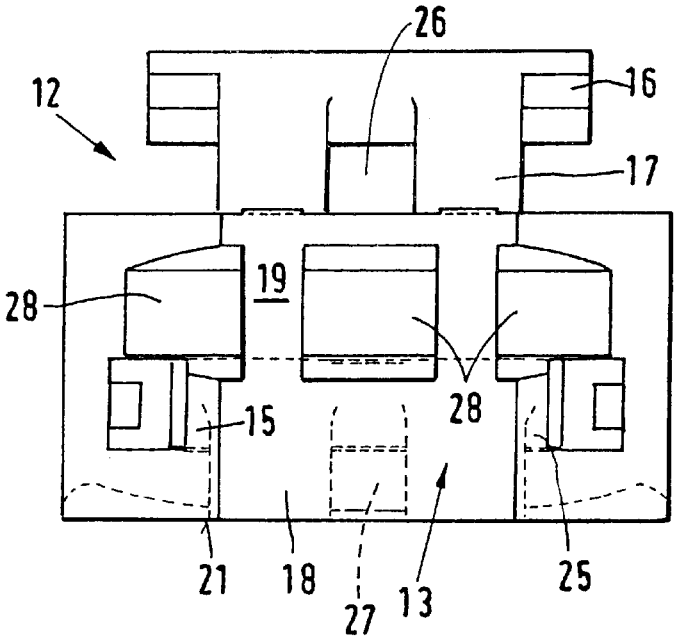
FIG.14
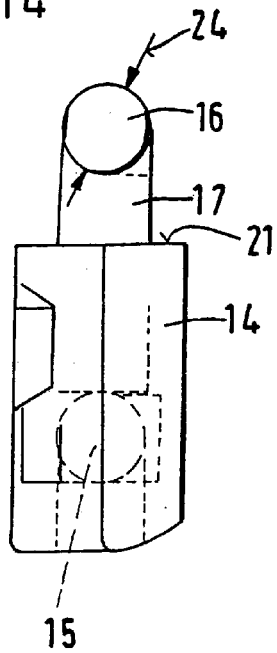
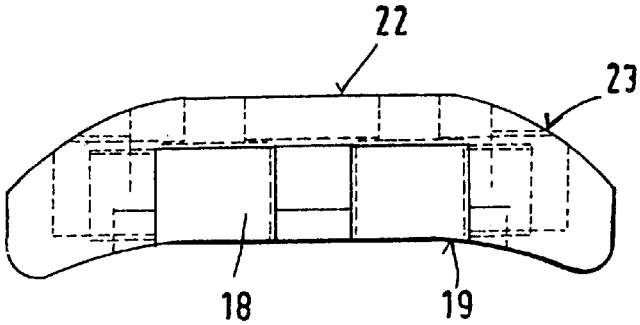
FIG.13

GLOVE WITH A REINFORCEMENT STRIP

BACKGROUND OF THE INVENTION

1. Field of the Invention

The present invention relates to a glove with a reinforcement strip formed of a plurality of arranged one after another, reinforcement members with each two adjacent reinforcement members being connected with each other by a hinge element and having facing each other stop surfaces that abut each other in the extended position of the two adjacent reinforcement members.

2. Description of the Prior Art

A glove worn on a hand covers the hand joints and should impair the mobility of the hand in the joints as little as possible. The joints of the hand naturally allow a forward rotation and are limited with respect to a rearward rotation. When the limitation of the rearward rotation is overcome by force, the joint or another part of the hand breaks. With respect to many useful purposes of gloves, there exists the danger that an excessive force will be exerted on the hand provided with the glove that will overcome the limitation of the rearward rotation by applying a force above that exerted by the hand itself. This danger is present, for example, in a goalkeepers glove or a construction worker's glove. Therefore, the upper side of the glove is provided in the regions associated with a respective joint with a reinforcement strip which allows the forward rotation of the joint and is stiff and rigid against the rearward rotation beyond the natural limitation and which, therefore, prevents the joint or another part of the hand from breaking due to an excessive force.

German Patent DE-35 16 545 C2 discloses a glove of the type mentioned above. The rotational connections between the adjacent reinforcement members of the glove reinforcement strip are designed as bending areas which are formed by an inner material layer which is continuous over the reinforcement strip and which carries the reinforcement members. Each two adjacent reinforcement members face one another by their ends which form the contact surfaces. This reinforcement strip can be manufactured in an economical manner. The bending areas must be made relatively powerful since they must hold together not only the reinforcement members but must also absorb tearing stresses and excessive forces which are directed to overcoming the limitation of the rearward rotation. Consequently, the bending areas oppose the rotation with considerable resistance to be overcome by the hand wearing the glove. Accordingly, because of the stiffness of the bending areas, when bending and stretching, the glove-wearing hand has additional work to perform because of the bending areas of the glove, which contributes to fatigue of the hand.

Therefore, it is an object of the present invention to provide a glove of the type mentioned above in which the rotational or hinge connections of the reinforcement strips are designed so as to allow an easier movement.

SUMMARY OF THE INVENTION

This and other objects of the present invention, which will become apparent hereinafter are achieved by forming a pivot joint, which connects each two adjacent reinforcement members of a bearing cavity and a pivot engaging in the bearing cavity with a possibility of a rotational movement therein.

When constructed in a corresponding manner, the pivot joint ensures a smooth-running pivotal movement of every two adjacent reinforcement members relative to one another. In the glove according to the present invention, the reinforcement strip is prevented from contributing to fatigue of the hand. The glove according to the present invention is generally used as a sports glove, primarily as a goalkeeper's glove. The pivot joint according to the present invention increases smoothness of the pivotal movement of the reinforcement strip which is of an increased importance in a sports glove. The reinforcement strip is associated, for example, with the wrist joint, also with the glove extending over the wrist joint to the forearm. As a rule, however, the reinforcement strip is associated with the joints of a finger, wherein it extends from the distal phalanx of the finger to the back of the hand.

The reinforcement members are formed as block-like formations which are arranged adjacent to one another and not as gutter or channel formations which overlap one another. Accordingly, the stop faces are arranged transverse to the longitudinal extension of the reinforcement strip and are not arranged in the direction of the longitudinal extension of the reinforcement strip. The pivot connections are not formed by an inner layer of the glove at which channel formations are arranged by eyelets. Rather, the pivot connections are formed by pivot joints which ensure a relatively precise guidance of the reinforcement members against one another and which are not loose or slack.

It is possible for projections or shoulders, which form the pivots and bearing cavities, to be arranged subsequently at a trunk or body of the housing. However, it is particularly advisable and advantageous when the reinforcement members provided with the pivots, and bearing cavities are injection-molded in one piece. This enables economical manufacture of the reinforcement strip of the glove according to the invention. The economical manufacture of the reinforcement strip is a precondition for its usability in practice.

It is conceivable that every two adjacent reinforcement members are provided with sleeves forming the bearing cavities, and a pin, which forms the pivot, is inserted through coaxially arranged sleeves. However, it is particularly advisable and advantageous when, with respect to two adjacent reinforcement members, when the pivot, which is inserted into the bearing cavity, forms with cavity a snap connection with the reinforcement members being provided with snap locking means. This simplifies the manufacture of the reinforcement strip because the assembly of the reinforcement members to form reinforcement strips is simplified.

In one of the embodiments of the invention, with respect to two adjacent reinforcement members, the pivot joint is formed of two joint parts associated with respective reinforcement members. The two joint parts are designed differently with one reinforcement member being provided on both sides with the first joint part and the other reinforcement member being provided on both sides with the second joint part. However, it is particularly advisable and advantageous when, with respect to two adjacent reinforcement members, with the pivot joint being formed of two joint parts, when each reinforcement member is provided with a first joint part on its one side and with a second joint part on its other side. This simplifies the production of the reinforcement members as well as the assembly of the reinforcement members to form the reinforcement strip.

It is then particularly advisable and advantageous when the two ends of the reinforcement strip are formed by a member which forms a joint part at the free end. This unused joint part which is located at the free end is not unsightly because it is concealed in the glove and circumvents the use of a special member which is free of the joint part at one end.

It is likewise particularly advisable and advantageous when each pivot joint forms, on the one hand, a shoulder with two coaxial pivots which project laterally away from the shoulder and, on the other hand, a bearing cavity which receives the two pivots and the end of the shoulder, and a recess or cutout which receives the shoulder. This results in a relatively simple, very stable pivot joint which is favorable with respect to injection molding technique.

The novel features of the present invention, which are considered as characteristic for the invention, are set forth in the appended claims. The invention itself, however, both as to its construction and its mode of operation, together with additional advantages and objects thereof, will be best understood from the following detailed description of preferred embodiment, when read with reference to the accompanying drawings.

BRIEF DESCRIPTION OF THE DRAWINGS

In the drawings:

FIG. 11 shows a perspective top view of another reinforcement member of a reinforcement strip;

FIG. 12 shows a bottom view of the reinforcement member shown in FIG. 11;

FIG. 13 shows a front view of the reinforcement member shown in FIG. 11; and FIG. 14 shows a side view of the reinforcement member shown in FIG. 11.

DETAILED DESCRIPTION OF THE PREFERRED EMBODIMENT

Figure 1:
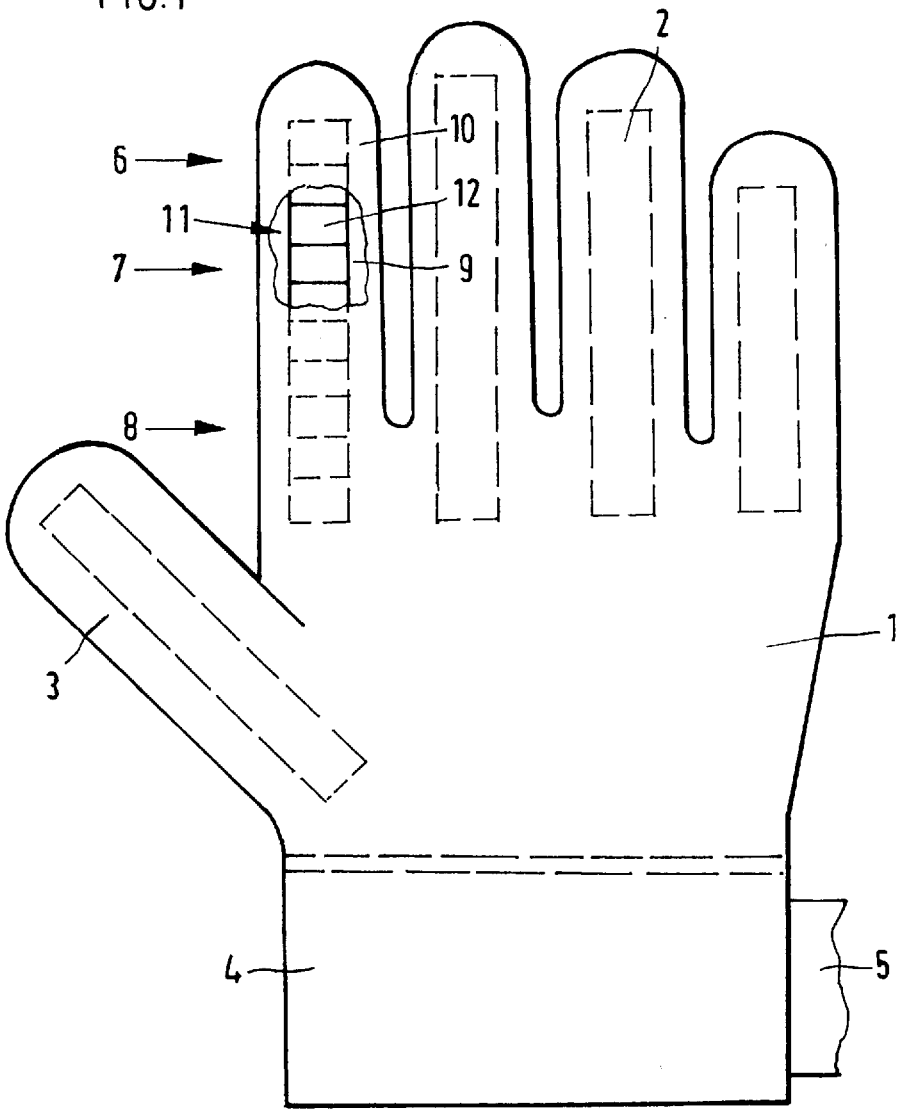
FIG. 1 shows a top view of the upper hand side of a glove according to the present invention, with a broken-out view.

A glove, which is shown in the drawing, is a goalkeeper's glove and has a palm area 1, four forefinger areas 2, a thumb area 3, and a wrist area 4 which has a VELCRO® strip 5 for tight fastening of the glove on a human hand (not shown). In the forefinger areas 2 and the thumb area 3, the human hand forms front joints 6, middle joints 7, and root joints 8 in the positions indicated by arrows. The glove comprises an upper hand part which has the forefinger areas 2, the thumb area 3, and the palm area 1, an inner layer 9 facing the hand and an outer layer 10 facing the outside of the glove. A reinforcement strip 11 comprising reinforcement members 12 is embedded between the inner layer 9 and the outer layer 10 for every forefinger area 2 and the thumb area 3.

Figure 2:
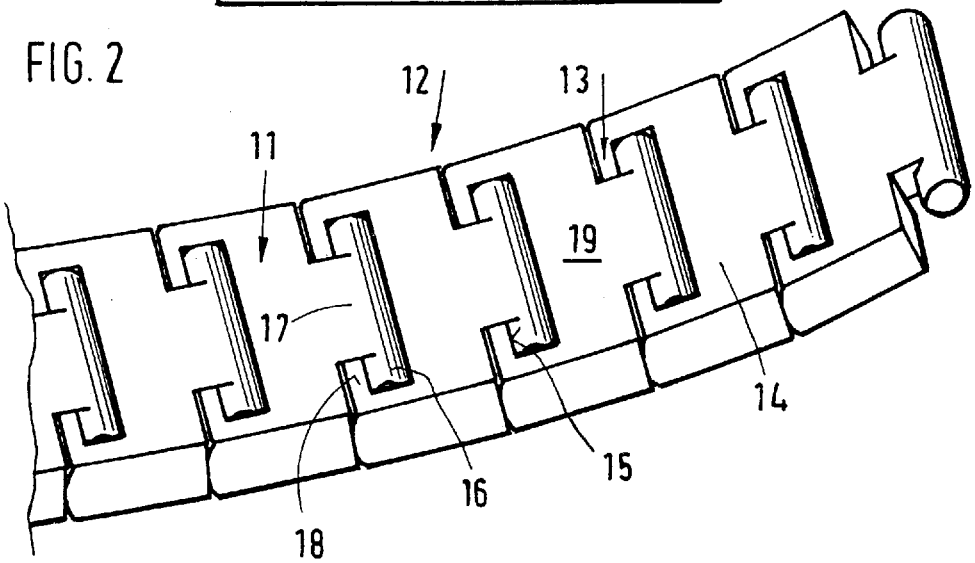
FIG. 2 shows a perspective view of a portion of a reinforcement strip of the glove shown in FIG. 1 at an increased scale compared with FIG. 1.
Figure 3:
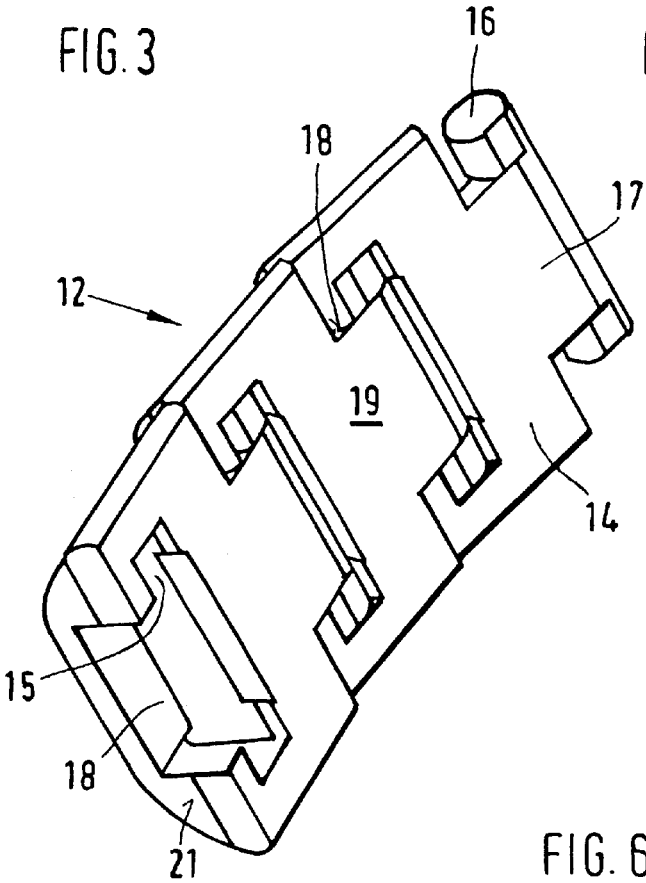
FIG. 3 shows a perspective bottom view of the portion of the reinforcement strip shown in FIG. 2.
Figure 4:
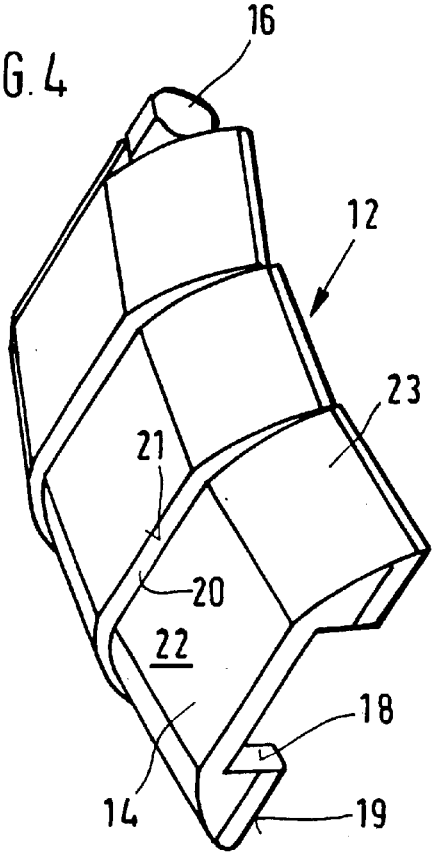
FIG. 4 shows a perspective top view of the portion of the reinforcement strip shown in FIG. 3.

According to FIG. 2, the reinforcement members 12 are formed identically and are joined together or fitted to one another individually in a chain-like manner, namely, by pivot joints 13. Every reinforcement member forms a block-like body 14 in which a bearing cavity 15 of the pivot joint 13 provided on the one side and pivots 16 are provided as projections on the other side. The projection comprises a central shoulder 17 which carries the two pivots 16 so that they project away laterally. The body 14 is provided with a cutout 18 which allows the shoulder 17 to pass into the bearing cavity 15. The bearing cavity 15 and the pivots 16 extend transverse to the longitudinal extent of the reinforcement strip 11. The reinforcement strip 11 forms an inner side 19 toward which the pivot joint 13 is arranged and toward which the reinforcement strip 11 is bent or curved.

Figure 5:
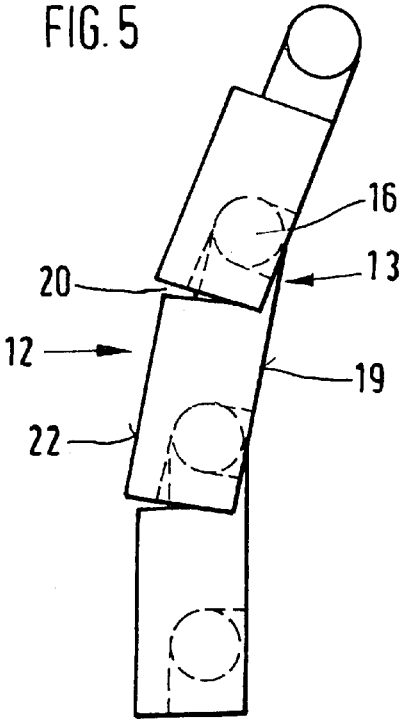
FIG. 5 shows a side view of the reinforcement strip portion shown in FIG. 3.
Figure 6:
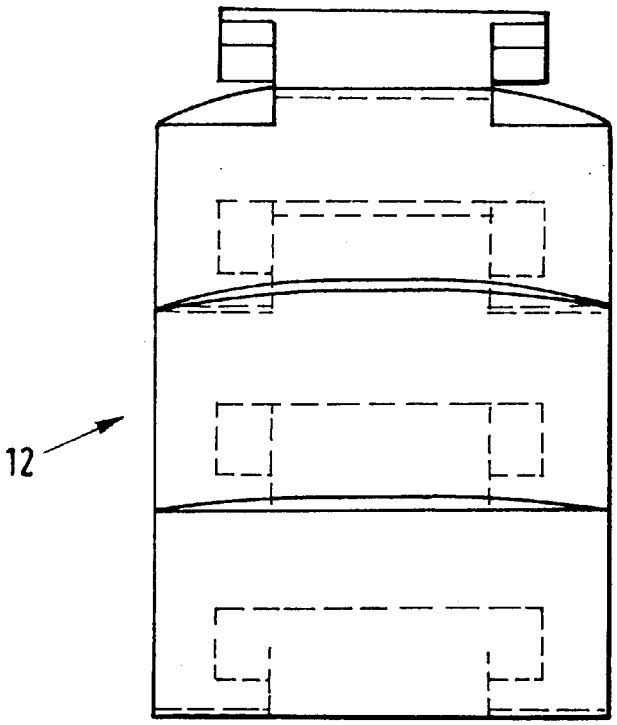
FIG. 6 shows a top view of the part according to FIG. 3.
Figure 8:
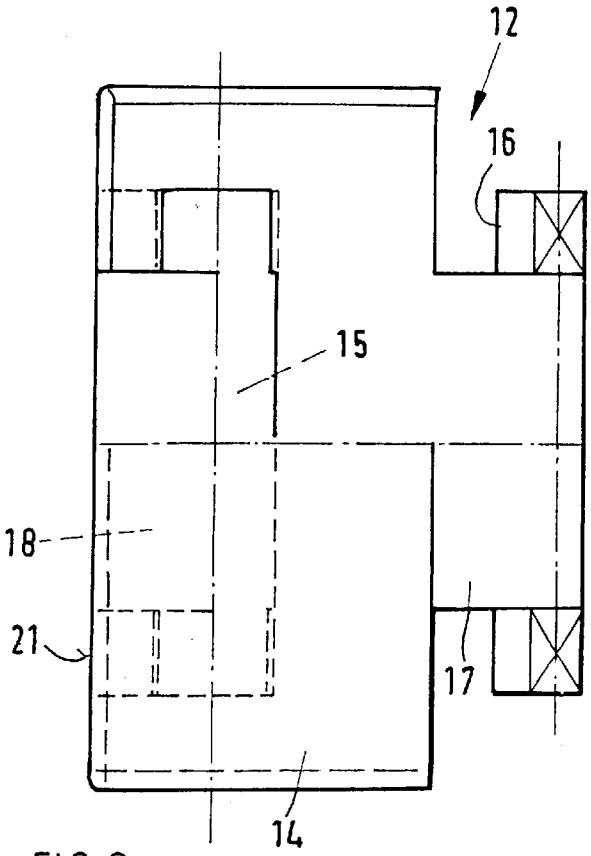
FIG. 8 shows a top view of the reinforcement member shown in FIG. 7.
Figure 9:
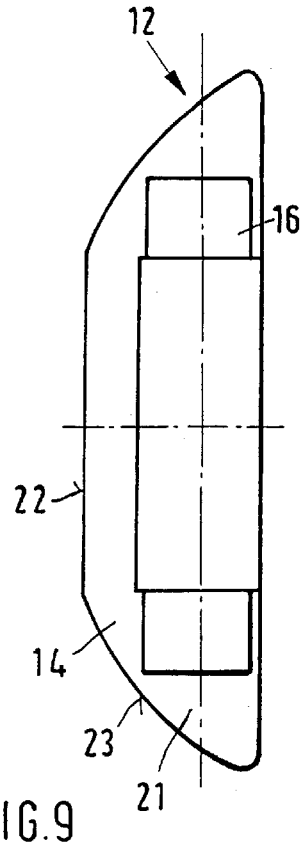
FIG. 9 shows a right side view of the reinforcement member shown in FIG. 8.
Figure 7:
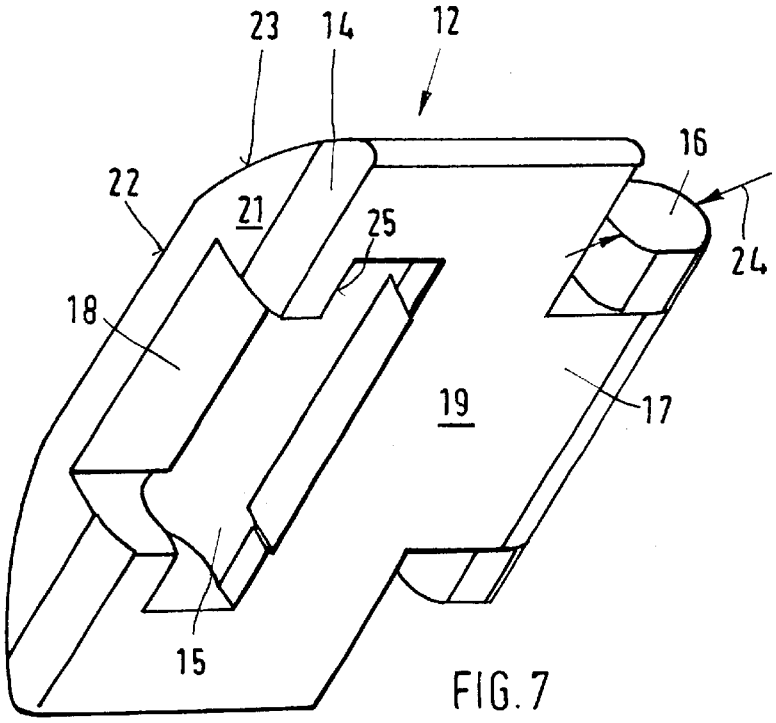
FIG. 7 shows a perspective view of a reinforcement member of the reinforcement strip shown in FIG. 2 at an increased scale compared to FIG. 2.
Figure 10:
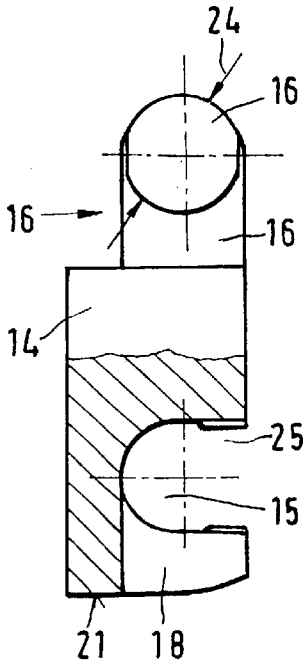
FIG. 10 shows a partially cross-sectional side view of the reinforcement member shown in FIG. 8.

FIGS. 3 to 6 show three reinforcement members 12 of the reinforcement strip 11 in a slightly curved or bent position of the reinforcement strip 11. According to FIG. 3, the pivots 16 are provided coaxially at the shoulder 17 and the width of the shoulder 17 extends over more than a third of the width of the reinforcement member 12. The pivots 16 are at a distance from the body 14. In the curved position, the shoulders 17 are raised out of the cutouts 18 to a greater or lesser extent. According to FIG. 4, end surfaces of two adjacent reinforcement members 12 face one another and define between them a wedge-shaped gap 20, in the bent position, and abut each other as stop faces 21 in the extended position of the reinforcement strip 11. The cutout 18 in the body 14 can be seen. On the side located opposite the inner side 19 in the middle, the reinforcement member 12 forms a surface 22 which is parallel to the inner side, and a diagonal surface 23 laterally adjoining on both sides, so that the thickness of the member 12 decreases toward both sides. FIG. 5 illustrates the position of two adjacent members 12 relative to one another and the position of the pivot joint 13 in the curved position of the reinforcement strip.

FIGS. 7 to 10 illustrate the reinforcement member 12 of the reinforcement strip 11. The reinforcement member 12 is provided with snap locking means 24, 25. The distance of the entrance 25 to the bearing cavity 15 is somewhat smaller than the diameter 24 of the pivot to be pushed in through the entrance 25. The pivot is pushed into the bearing cavity 15 with increased force accompanied by an expansion of the entrance and can also not exit again from the latter under the stresses to which the reinforcement strip 11 is subject.

The reinforcement member 12 according to FIGS. 11 to 14 and the associated reinforcement strip is formed as described with reference to FIGS. 2 to 10, and this description is applicable to FIGS. 11 to 14. The reinforcement member 12 according to FIGS. 11 to 14 is further developed insofar as it has, in the shoulder 17, a guide channel 26 which is continuous from the inner side 19 to the outer side and is provided in the cutout 18 with a guide pin 27. When two reinforcement members 12 are put together, then the guide pin 27 enters into the guide channel 26. This design does not hinder the rotation of the two reinforcement members about the axis of the pivot 16, but rather helps to prevent unwanted rotation of the reinforcement members relative to one another about the longitudinal axis of the reinforcement strip. The body 14 is provided with additional cavities 28 to lessen its weight.

Though the present invention was shown and described with reference to the preferred embodiment, such are merely illustrative of the present invention and are not to be construed as a limitation thereof, and various modifications to the present invention will be apparent to those skilled in the art. It is, therefore, not intended that the present invention be limited to the disclosed embodiment or details thereof, and the present invention includes all of variations and/or alternative embodiments within the spirit and scope of the present invention as defined by the appended claims.

What is claimed is:

1. A glove, comprising a palm area (1); four forefinger areas (2); a thumb area (3); a wrist area(4); and reinforcement strips (11) embedded in the forefinger and thumb areas, respectively, and having each a plurality of reinforcement members (12) arranged in a row, and a respective plurality of pivot joints for connecting each two adjacent reinforcement members, wherein the two adjacent reinforcement members have respective stop surfaces facing each other and abutting one another in an extended position of the two adjacent members, wherein each pivot joint (13) includes a bearing cavity (15) and a pivot (16) engaging in the bearing cavity; and wherein the bearing cavity (15) is formed in one of the two adjacent reinforcement members.

2. A glove according to claim 1, wherein each reinforcement member has the bearing cavity (15) at one end thereof and the pivot (16) at another opposite end thereof.

3. A glove according to claim 2, the reinforcement members (12) are formed by an injection-molding.

4. A glove according to claim 1, wherein opposite end reinforcement members (12) of the reinforcement strip (11) include, as an integral part thereof one of the bearing cavity (15) and the pivot (16).

5. A glove according to claim 1, wherein the pivot (16) is provided in another of the two adjacent reinforcement members.

6. A reinforcement strip for a glove, comprising a plurality of reinforcement members (12) arranged in a row, and a respective plurality of pivot joints for connecting each two adjacent reinforcement members, wherein the two adjacent reinforcement members have respective stop surfaces facing each other and abutting one another in an extended position of the two adjacent members, wherein each pivot joint (13) includes a bearing cavity (15) and a pivot (16) engaging in the bearing cavity, and wherein the bearing cavity (15) is formed in one of the two adjacent reinforcement members.

7. A reinforcement strip according to claim 6, wherein the pivot is provided in another of the two adjacent reinforcement members.

8. A glove, comprising a palm area (1); four forefinger areas (2); a thumb area (3); a wrist area(4); and reinforcement strips (11) embedded in the forefinger and thumb areas, respectively, and having each a plurality of reinforcement members (12) arranged in a row, and a respective plurality of pivot joints for connecting each two adjacent reinforcement members, wherein the two adjacent reinforcement members have respective stop surfaces facing each other and abutting one another in an extended position of the two adjacent members, wherein each pivot joint (13) includes a bearing cavity (15) and a pivot (16) engaging in the bearing cavity, and wherein the bearing cavity (15) is formed in one of the two adjacent reinforcement members (2), and the pivot (16) is provided on another of the two adjacent reinforcement members, and wherein the cavity (15) and the pivot (16) are associated with respective snap locking means (24, 25) for providing a snap locking engagement of the pivot (16) in the bearing cavity (15).

9. A glove, comprising a palm area (1); four forefinger areas (2); a thumb area (3); a wrist area(4); and reinforcement strips (11) embedded in the forefinger and thumb areas, respectively, and having each a plurality of reinforcement members (12) arranged in a row, and a respective plurality of pivot joints for connecting each two adjacent reinforcement members, wherein the two adjacent reinforcement members have respective stop surfaces facing each other and abutting one another in an extended position of the two adjacent members, wherein each pivot joint (13) includes a bearing cavity (15) and a pivot (16) engaging in the bearing cavity, and wherein each pivot joint (13) forms a shoulder (17) with two coaxial pivots (16) which project laterally away from the latter, and the bearing cavity (15), which receives the two pivots and the end of the shoulder, has a cutout (18) which receives the shoulder.

* * * * *